US009340341B2

(12) United States Patent
Farrell

(10) Patent No.: US 9,340,341 B2
(45) Date of Patent: May 17, 2016

(54) CORD MANAGEMENT ORGANIZER

(71) Applicant: Edwin B. Farrell, Saline, MI (US)

(72) Inventor: Edwin B. Farrell, Saline, MI (US)

( * ) Notice: Subject to any disclaimer, the term of this patent is extended or adjusted under 35 U.S.C. 154(b) by 0 days.

(21) Appl. No.: 14/617,891

(22) Filed: Feb. 9, 2015

(65) Prior Publication Data

US 2015/0225150 A1 Aug. 13, 2015

Related U.S. Application Data

(60) Provisional application No. 62/052,661, filed on Sep. 19, 2014, provisional application No. 61/937,558, filed on Feb. 9, 2014.

(51) Int. Cl.

| | |
|---|---|
| ***B65D 63/14*** | (2006.01) |
| ***B65D 63/10*** | (2006.01) |
| ***A45F 5/02*** | (2006.01) |
| ***H04R 1/10*** | (2006.01) |

(52) U.S. Cl.

CPC . *B65D 63/14* (2013.01); *A45F 5/02* (2013.01); *B65D 63/109* (2013.01); *H04R 1/1033* (2013.01); *A45F 2005/023* (2013.01); *A45F 2200/0508* (2013.01); *Y10T 24/1498* (2015.01)

(58) Field of Classification Search

CPC .. B65D 63/14; Y10T 24/1498; Y10T 24/141; Y10T 24/14; H04R 1/1033; B65H 2701/34; B65H 2701/3919; F16G 11/00

See application file for complete search history.

(56) References Cited

U.S. PATENT DOCUMENTS

| | | | | |
|---|---|---|---|---|
| 3,197,830 | A | 8/1965 | Hoadley | |
| 3,275,969 | A | 9/1966 | Sheeran | |
| 5,024,402 | A | 6/1991 | Hamel | |
| 5,502,877 | A | 4/1996 | Yocum | |
| 5,573,420 | A * | 11/1996 | Grosswendt | 439/371 |
| 5,745,958 | A | 5/1998 | Kaldor | |
| 6,238,235 | B1 | 5/2001 | Shavit et al. | |
| 6,523,229 | B2 | 2/2003 | Severson | |
| 6,543,094 | B2 | 4/2003 | D'Addario | |
| 7,399,199 | B2 | 7/2008 | Symons | |
| 7,607,618 | B2 | 10/2009 | Mori et al. | |
| 7,699,643 | B1 | 4/2010 | Rodriquez | |
| 7,712,696 | B2 * | 5/2010 | Loh | 242/360 |

(Continued)

FOREIGN PATENT DOCUMENTS

WO WO2013062477 A1 5/2013

OTHER PUBLICATIONS

Quirky's Wrapster, earbud cord wrap; Source: https://www.quirky.com/shop/31-wrapster-earbud-cord-wrap; accessed on Feb. 5, 2015, 2 pages.

(Continued)

*Primary Examiner* — Robert J Sandy
*Assistant Examiner* — Michael Lee
(74) *Attorney, Agent, or Firm* — Reising Ethington P.C.

(57) ABSTRACT

A cord management organizer for use with an electrical cord having a plug end and a length of insulated wire. The organizer includes an elongate body extending from a first end to a second end, a plug retention opening proximate the second end, and an enlarged body portion adjacent the first end. The enlarged body portion has a thickness greater than a corresponding thickness of the body at a central region that is located intermediate the plug retention opening and enlarged body portion. The enlarged body portion includes a passageway having a central axis that extends in an elongate direction towards the central region of the body.

9 Claims, 8 Drawing Sheets

(56) References Cited

U.S. PATENT DOCUMENTS

| | | | | |
|---|---|---|---|---|
| 8,139,809 | B2 | 3/2012 | Jubeirer et al. | |
| 8,510,918 | B2 | 8/2013 | Shilale et al. | |
| 8,523,098 | B2 | 9/2013 | Detweiler | |
| 8,590,823 | B2 | 11/2013 | Rothbaum et al. | |
| 8,615,849 | B2 | 12/2013 | Rothbaum et al. | |
| 2005/0251967 | A1 | 11/2005 | McNeill | |
| 2007/0039912 | A1 | 2/2007 | Hinkens | |
| 2009/0022352 | A1 | 1/2009 | Weibel | |
| 2009/0106948 | A1 | 4/2009 | Lopez et al. | |
| 2011/0308049 | A1 | 12/2011 | Sun | |
| 2013/0168478 | A1 | 7/2013 | Holman | |
| 2014/0367139 | A1 * | 12/2014 | Petersen | 174/79 |

OTHER PUBLICATIONS

Quirky's Props, Adjustable-length earbud retainer; Source: https://www.quirky.com/shop/254-props-earbud-holder; accessed on Feb. 5, 2015, 2 pages.

Cliphone, cable organizer; Source: www.Cliphone.com; accessed on Feb. 5, 2015, 2 pages.

Three1design's MaCO, magnetic cable organizer; Source: www.Three1design.com; accessed on Feb. 5, 2015, 4 pages.

International Search Report for application No. PCT/US2015/015072, dated May 14, 2015, 3 pages.

Written Opinion for application No. PCT/US2015/015072, dated May 14, 2015, 5 pages.

* cited by examiner

FIG. 9 a.
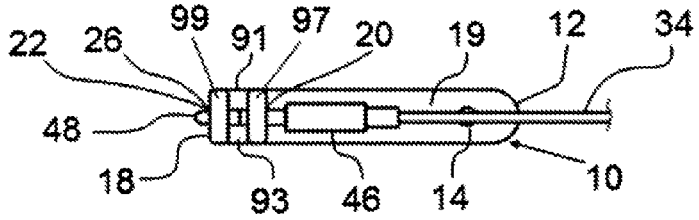
FIG. 9 b.
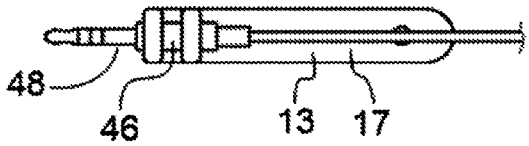
FIG. 9 c.
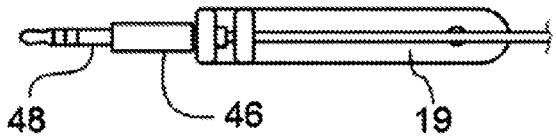
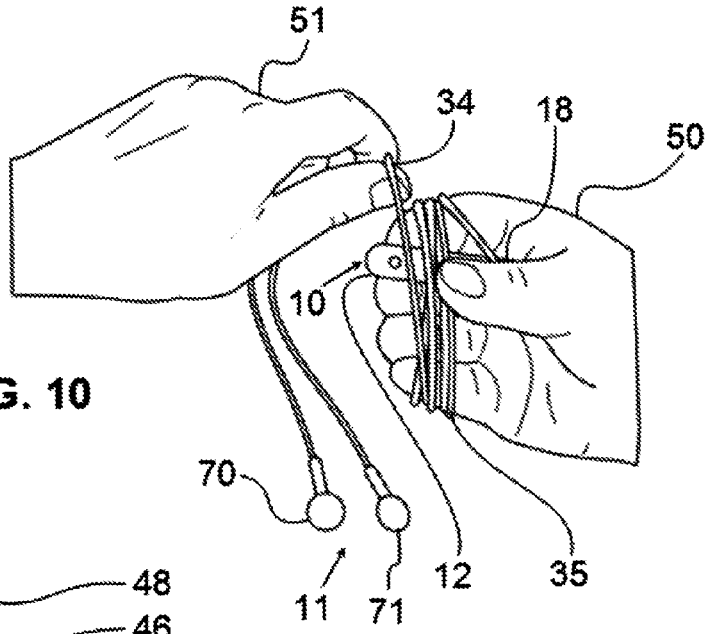
FIG. 10
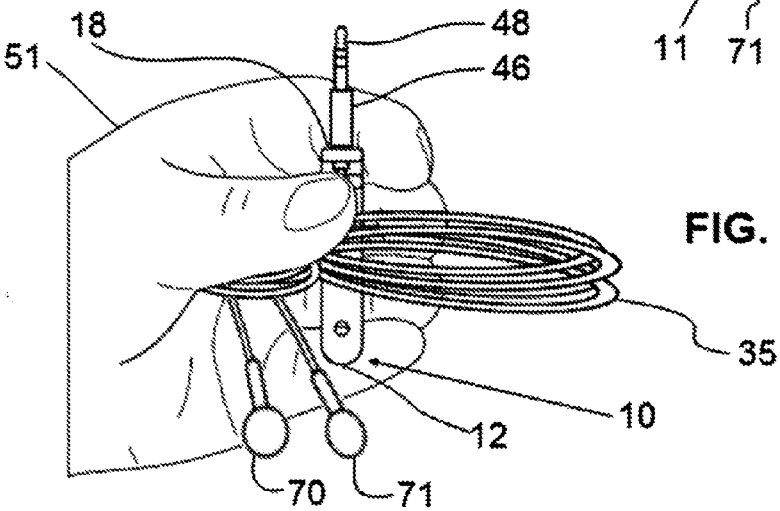
FIG. 11

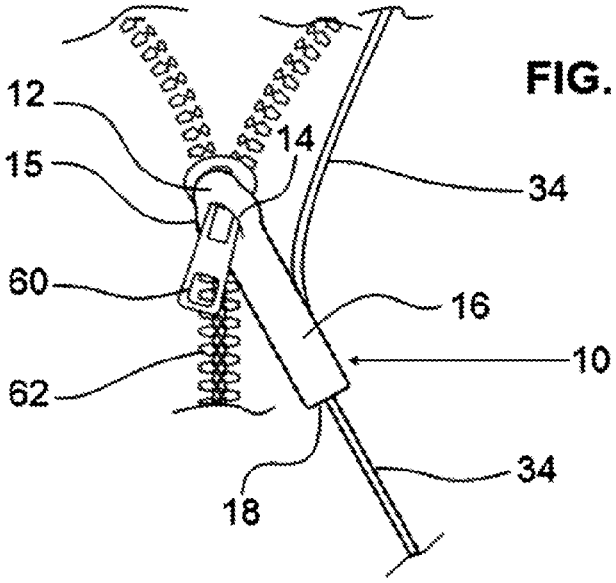
FIG. 15
FIG. 16
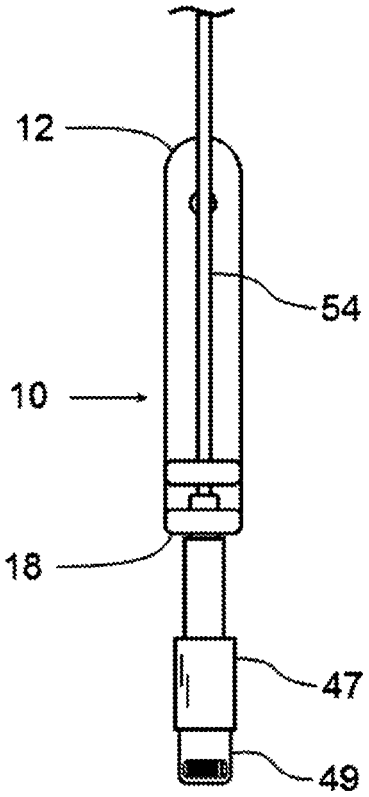
FIG. 17
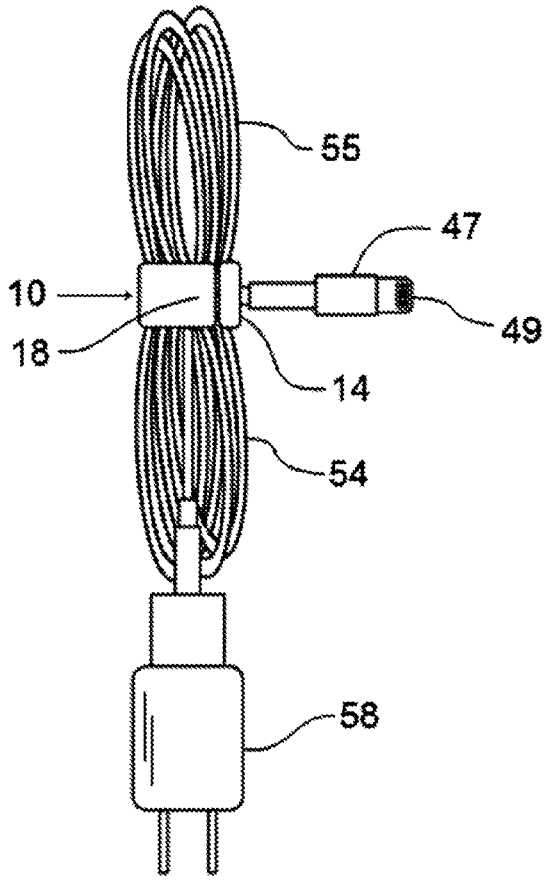

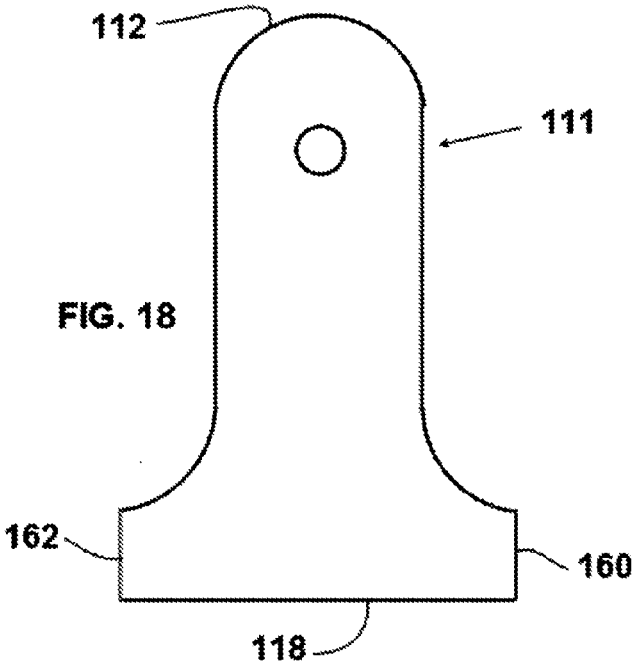
FIG. 18
FIG. 19
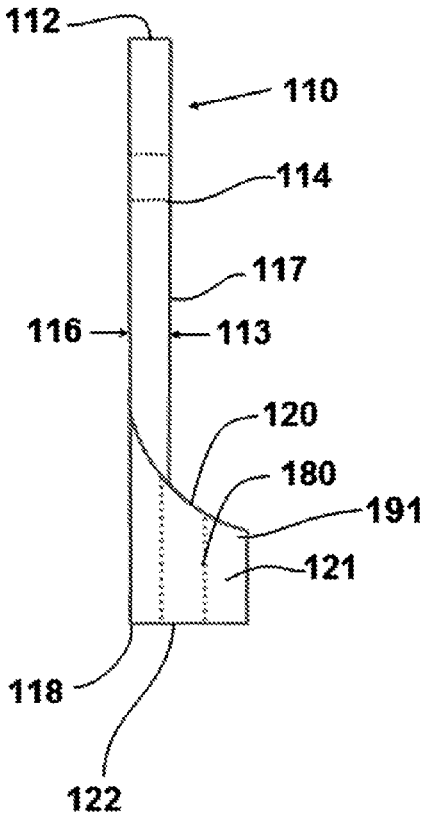
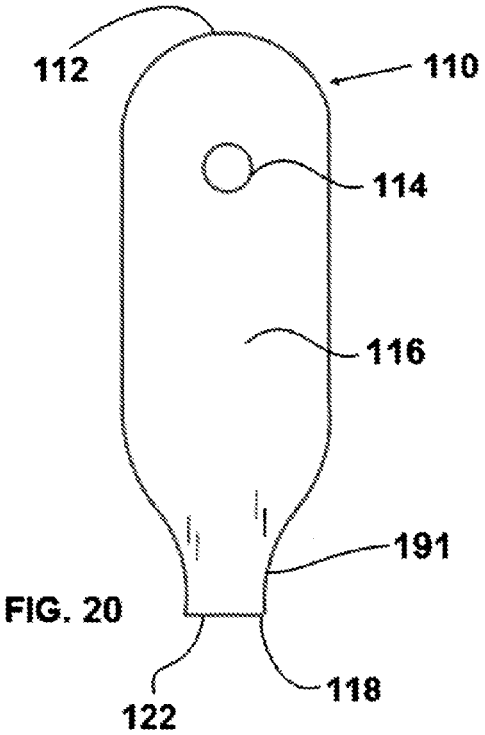
FIG. 20
FIG. 21
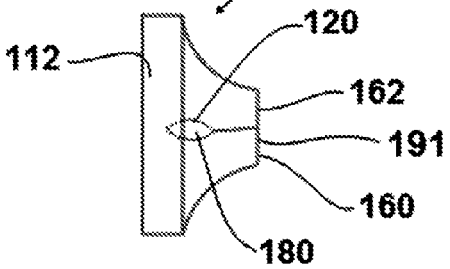

CORD MANAGEMENT ORGANIZER

CROSS-REFERENCE TO RELATED APPLICATIONS

This application claims the benefit of U.S. Provisional Application No. 62/052,661 filed Sep. 19, 2014, and claims the benefit of U.S. Provisional Application No. 61/937,558 filed Feb. 9, 2014. The complete contents of these earlier applications are hereby incorporated by reference.

TECHNICAL FIELD

The present invention relates to cord management methods and devices for computing and portable electronic, devices, particularly though not exclusively, to earphones. Other such devices include smartphones, laptops, tablets and similar devices that have pliable and flaccid cords for charging batteries, power and syncing data.

BACKGROUND

There are four well known and common problems users of such electronic devices, particularly earphones connected to a personal media player or smartphone, encounter with their cords:

1. Tangling. When earphones are placed in a confined space such as a pocket or purse, their cords tangles on itself. The tangled mess of cords causes a time-consuming and frustrating problem for users to have to untangle their earphone cords prior to use.
2. Storing in an organized, compact way. Since earphones are often stored in confined spaces, which may include other objects such as keychains, they can become en tangled in these other objects. Additionally, since the amount of space is restricted, and must be shared with other objects, it is desirable to minimize the amount of space required to store earphones. Additionally, users generally like to maintain their accessories in a neat and tidy way.
3. Shortening the cord when needed. Earphones have cords of various lengths and depending on the height of the user, or where the media player or smartphone is placed, for example on an armband while running, the excess slack in the cord may interfere with the experience.
4. Entanglement of the cord with other objects in the user's environment while earphones are in use, and supporting them in place. Users often put their smartphone in their pocket with an earphone cord extending to their ears, while engaging in a variety of activities. Sometimes the dangling cord can inadvertently snag on other objects such as a doorknob causing the earphones to be pulled forcefully from the user's ears resulting in potential discomfort or damage to the earphones. Also, if the user is engaging in a vigorous activity, like running or biking, the user risks the earphone's speakers' slipping out of their secure position in the user's ears and dropping to the ground, or worse becoming entangled in a bicycle's gears, potentially damaging them. One contributing factor to the earphones slipping out of their secure position in a user's ears is the weight of the dangling and bouncing cord, which pulls on the earphone speakers in the user's ears since the earphones generally do not have a way to retain or tether the cord to the user or other way to decrease the pull on the earphones. Additionally, during use, the user may need to remove the earphones to talk with someone and this requires holding them in the user's hand, which may be inconvenient, or dangling them over a shoulder temporarily, which risks the earphones failing onto the ground.

The description of the device in the application is generally focused on cord management devices for earphones due to unique challenges of these electronic devices versus other types of cords, though it should be understood that the cord management device can also be used for other types of cords (e.g. charging, data synchronization) which have similar cord management problems. The term earphones used throughout this application refers to any device also known as a headset, headphones, or earbuds. Devices for earphone cord management confront additional challenges resulting from the variety of cord lengths, diameters, shapes (flat or round), and placement of the inline microphones. Importantly, smartphones, and their accessories—such as smartphone cases and earphones—have been become fashion items and aesthetics or form is as important as function to the user. In at least one embodiment, the cord management organizer is attached to the cord—in effect—it is something that is "worn" and therefore seen by others. A cord management organizer that is semi-permanently attached to the cords necessitates additional functional and aesthetic requirements in order to be commercially viable.

Despite the above known and annoying problems, drawbacks with current solutions may have limited, their commercial viability. Prior art solutions address one or more of the above four problems depending on the device, but each approach has drawbacks that may include bulkiness, risk of loss due to not being attached to the cord, excessive weight, difficulty fitting diverse cords, time consuming to unwind and cost to manufacture. Therefore, there is a need for an improved cord management organizer that solves the above problems and combines multiple functions into a generally "one-size-fits all" device that remains unobtrusively attached to the cord for ready access.

SUMMARY

The present invention is directed to a device and method for using the device to manage the use of electrical cords of accessories for computing and portable consumer electronics, such as earphones, chargers and data synchronization systems. Such accessories have plug connectors and plug housings integrated in at least one end of the electrical cord for connecting portable electronic devices/accessories to each other or to electrical outlets to transfer either power or input/output signals. The plug housing covers a portion of the plug connector, which is the metal conducting portion that is inserted into the jack of portable electronics or an electrical outlet depending on the type of accessory.

Some embodiments of the present invention provide an accessory item in the form of a cord management organizer that serves three purposes. The cord management organizer lessens the likelihood of the cords from getting entangled with themselves or other items, e.g. keys, pens, or the like, and keeps them stored in a compact, organized way. A second function is enabling the cords to be adjusted in length to achieve a personalized length to eliminate excessive slack. The third function is a tethering feature allowing it to be releaseably fastenable by a user to objects on the user's clothing, such as buttons or zippers, to help minimize entanglement of the loose, dangling cord with other objects in the user's environment while in use, or—in the event of inadvertent dislodgement of the earphone's speaker from their secure position in the user's ears—to help prevent the cord and speakers from dropping to the ground, or to simply support the speaker end of the cord when the user temporarily removes them from their ears obviating the need for the user to hold the cord in hand.

Therefore, the cord management organizer according to some embodiments of the invention can serve as a smart, three-in-one device having three desirable functions—organizing tangle-free, shortening and tethering obviating the need to buy one or more devices to serve these needs, plus the advantage of fewer accessory items to keep track of. Lastly, even with its three-in-one function, it is small, lightweight and compact enough to be perceived as relatively unobtrusive, which is desirable since it is intended to be remain semi-permanently on the cord for ready access when needed and to prevent misplacement or loss.

In accordance with at least some embodiments, the cord management organizer is designed for use with an electrical cord having a plug end and a length of insulated wire, and the organizer comprises:

1. an elongate body extending from a first end to a second end.
2. a plug retention opening proximate the second end.
3. an enlarged body portion adjacent the first end, the enlarged body portion having a thickness greater than a corresponding thickness of the body at a central region that is located intermediate the plug retention opening and enlarged body portion, the enlarged body portion including a passageway having a central axis that extends in an elongate direction towards the central region of the body.

The enlarged body portion may be configured in at least some embodiments such that the plug end of the electrical cord is insertable into the passageway along a path of movement starting at the central region with the plug end being inserted through the passageway so that at least a portion of the plug end extends out of the passageway past the first to thereby define an assembled configuration of the organizer and electrical cord.

According to an embodiment, the body being flexible to permit wrapping of the body about a bundle of the insulated wire, wherein when in the assembled configuration, the first end of the body with the plug end of the cord can be placed at a central portion of the bundle and the body wrapped around the central portion of the bundle with the portion of the plug end being inserted into the plug retention opening to thereby secure the bundle against unbundling. Additionally, the body may comprise a material that exhibits elasticity, such as silicone.

For some embodiments, the passageway has a diameter when the material is in a relaxed state that is smaller than at least a portion of the plug end, with the elasticity of the material being sufficient to permit expansion of the opening to a size that allows the plug end to pass through the expanded passageway, whereby the body and electrical cord can be placed into an assembled configuration by inserting the plug end of the electrical cord through the passageway such that the plug end extends out of the passageway past the first end of the body and such that a section of the insulated wire that begins at the plug end extends from the passageway along a surface of the body towards the central region.

The plug retention opening has a diameter in at least some embodiments that permits at least a portion of the plug end of the electrical cord to extend through the plug retention opening, whereby when in the assembled configuration, the elongate body may be wrapped around a bundle of the insulated wire and at least the portion of the plug end inserted into the plug retention opening to thereby prevent unbundling of the insulated wire.

In accordance with one or more embodiments, there is also provided a cord management organizer for use with an electrical cord having a plug end, wherein the organizer comprises an elongate body having an end feature that interconnects the body to the cord at the plug end so that the interconnection of the body with the cord biases the organizer into at least partial alignment of the elongate body with a section of the cord that extends from the plug end.

In one or more embodiments, the elongate body extends from a first end to a second end and has an enlarged body portion adjacent the first end with a passageway extending through the enlarged body portion from a central region of the body to an opening formed in an end face of the body portion that is located adjacent the second end. The body may include for at least some embodiments a plug retention feature that is located in the body at the second end. The plug retention feature may comprise an opening through the body at the second end.

In accordance with one or more embodiments, there is also provided a cord management organizer for use with an electrical cord having a plug end, wherein the organizer comprises a body of elastic sheet material extending from a first end to a second end within a plane along a lengthwise direction when in an elastically-relaxed state, wherein the second end has a second opening through the sheet material. The first end has a portion of the sheet material extending out of the plane of the sheet material and secured to itself to thereby form an enlarged body portion, wherein the enlarged body portion includes a passageway extending through the secured sheet material at the second end.

According to some embodiments, the end aperture has a central axis that extends in the lengthwise direction. The sheet material at the first end is folded back towards a central region of the body and secured to another portion of the sheet material, whereby the first end of the body comprises a fold of the sheet material. The folded back sheet material is secured flat against the other portion of sheet material such that the folded back sheet material extends in the lengthwise direction from the fold to a location intermediate the fold and central region. The folded back sheet material is secured to the other portion of sheet material such that the folded back sheet material extends at an angle away from the plane. The sheet material at the first end is secured in a rolled configuration in which opposite lengthwise edges of the sheet material at the first end are connected together at a location above the plane to thereby define a central passageway having an axis extending in the lengthwise direction.

The material used for the elongate elastic band may be synthetic foam rubber, silicone foam rubber, silicone rubber or other suitable elastomer. IT may be made by any suitable technique, such as by being injection molded, compression molded, die-cut from sheets, or extruded with secondary hole punching and gluing or attachment operations. For some molded embodiments, one such rubber is 30 durometer hardness (Shore A) "ELASTOSIL™ R 401/30 S" silicone, supplied by Wacker Chemical. For embodiments made from sheet material, one such rubber is thin (2 mm-4 mm) sheets of closed cell foam, or sponge, synthetic rubber, commonly referred to by the Dupont™ brand name Neoprene, which has the desirable properties of elasticity, deformable, resilience, flexibility, soft to the touch, low-cost, easy to die cut and to sew, and commercially available in a wide variety of colors. The closed cell rubber may be laminated with nylon fabric on both or only one side. In some embodiments, it may be desirable to have the cord facing side of the elongate body, unlaminated, raw closed cell rubber since it functions to grip the bundled cords, which helps to maintain the band in a tensioned state during storage or shortening and results in an even more secure holding of the bundle of cords. Other elastomeric, resilient, deformable materials, such as silicone sheets, or other known materials with similar properties, may also be used. During manufacture, the material is die cut to the desired shape, including the die cutting of the apertures. Select sewing operations may also be performed on the unitary, one-piece of die-cut elongate material to form the desired structures and openings in other embodiments. Additionally, the device may be formed by an injection molding operation using synthetic silicone or silicone foam or other suitable materials.

The openings may be sized to allow the connector plug and plug housing to be threaded through the openings during different steps in operation—first to attach the device to the cord, then to use the device to secure the bundle. In operation, to attach the device to the cord, the connector plug and plug housing may be threaded and pushed through the opening at the first end of the band, starting from the side of the opening adjacent to the elongate body, until the opening and band are in a position on the cord of the accessory, adjacent to the housing.

Due to unique alignment structures at the first end of the elongate body, the elongate length of the band is maintained in axial alignment with the cord. The openings may be sized to be slightly smaller than the diameter of the connector plug. At least a portion of the first opening may be slightly smaller than the diameter of the cord. The elastically resilient material allows the opening to stretch effectively increasing the diameter of the opening temporarily, allowing the insertion of the connector plug housing through the elastically resilient opening with a small amount of pushing by the user. Once the opening and first end of the cord management organizer is pushed over the housing and unto the cord, the surface area around the opening remains in contact with the cord, such that the first end of the device remains in a relatively static position on the cord due to the resilient clamping force of the elastic material, unless the user moves the band. Additionally, depending, on the embodiment, a unique structure formed by material at the first end may also function to maintain the elongate band in axial alignment with the cord.

In at least some embodiments, the elongate length of the band is sized such that, in relaxed state, it is less than the circumference of the fully coiled bundle of cords it is to secure. Additionally, the length from the first opening to the second opening may be less than circumference of the fully coiled bundle of cords, allowing for a short portion—from the plug retention opening to the second end for the purpose of gripping the second end of the band during securing. A shorter band provides some advantages: it allows for storage in a slightly tensioned state and it minimizes the size of the device, reduces cost and potential interference with the user or objects in the user's environment while improving its appearance. Also, the band does not need to completely encircle the bundle of cords since its unique design can cooperate with a portion of the cord to complete the loop around the bundle.

In the embodiments identified above the cord management organizer may be secured on the cord and then used as follows. The user manually coils the cords into an elongate bundle and places the bundle on the band in transverse alignment to both the band and the plug and plug housing. The user holds the first end of the elongate band in contact with bundle, then wraps the second and opposite end of band partially around the central portion of the coiled bundle, but since it is shorter in elongate length than the circumference of the bundle, the band cannot fully encircle the bundle. The user then elastically elongates the band by pulling on the second end, then threads the connector plug and connector plug housing through the second opening at the second end of the band and slides the second end of the band over the connector plug and housing until the opening and second end is in a position on the cord adjacent the plug housing, thereby the band cooperates with a portion of the cord to form a complete loop around the bundle thereby securing the bundle with the band remaining in a slightly tensioned state, unlike prior art bands that fully encircle the bundle and rely on integrated fasteners to secure the band. The band remains in a slightly tensioned state thereby securely retaining the bundle of cords. The edge of the plug housing facing the cord can act as a retainer holding the second end of the band in place and helping to maintain the band in a tensioned state. Unlike other prior art that employ a dowel pin or other integral retainers such as hooks, the organizer employs the accessory cord's own structure (the plug housing) as a retainer.

The material on the inside of the openings of the band may in some embodiments be rubber-like to impart a gripping force for friction that resists axial movement of the band with respect to the cord) on the cord to retain the band in position and in a slightly tension state without the use of traditional fasteners. If the second end of the band is positioned adjacent to the housing of the plug, the slight projection of the housing further resists axial movement of the second end of the band in the direction of the plug, helping to maintain the elastic band in a slightly stretched state around the bundle and to securely retain the bundle in an organized state.

Different embodiments provide several different ways of creating the enlarged body portion and passageway at the first end, using the same material of the elongate band, to facilitate holding the first end in a relatively static position to hold the bundle of cords in a secure position during both the wrapping step and in the assembled configuration. In one embodiment, first opening can be formed using an elongate die cut piece of closed cell rubber in the shape of an inverted. "T", with the side portions or tabs affixed to form an oblong opening with a passageway in axial alignment with the elongate length of the elongate band. By affixing/sewing the two tabs/corners of the first end to form the opening, the two affixed tabs form a small enlargement in a transverse position to the plane of the elongate body and they contain raw edges of closed cell rubber. In this embodiment, the material of the band is fabric covered closed cell foam. During the securing or wrapping step, the exposed edges of closed cell rubber of the first end are placed in contact with the coiled bundle or cords and, in addition to the enlargement formed by affixing the two sides of the band, serve to further resist circumferential movement of the band relative to the bundle during both wrapping and the assembled configuration, which is helpful in keeping the band securely retaining the bundle. The formation of the passageway at the first end of the band in the above method serves an another useful purpose; it maintains the elongate band in axial alignment with the plug and cord, thereby facilitating the insertion of the plug into second opening during the step to couple the band with the cord around the bundle.

In another embodiment, an enlarged body portion at an approximate right angle to the elongate plane of the flat body of the cord management organizer is created by a simple sewing operation of a folded portion of the first end of the elongate body. The enlargement also has the first opening adjacent the seam and centered; the function of the enlargement with the first opening is to maintain the elongate body of the device in axial alignment with the cord and plug housing and to serve to hold the first end in a relatively static position both during wrapping and the assembled configuration. The cord threaded through the opening puts a circumferential clamping force on the enlargement against the bundle facilitating holding the first end in position.

According to another embodiment, the cord management organizer is made from molded silicone rubber, liquid silicone rubber, thermoplastic elastomer (TPE) or other suitable elastomer. The manufacturing process could be either injection molding or compression molding. The molded embodiment allows more complex geometries for the enlarged body portion. In this embodiment, the cord management organizer has an elongate body extending from the first end to the second end with a plug retention opening proximate the second end and an enlarged body portion adjacent the first end.

In this embodiment, the enlarged body portion at the first end has a pair of ridge portions, integrally connected by a support portion. The elongate body of the cord management organizer has a first facing side and a second facing side. The height of the support portion is less than the height of ridge portions effectively creating a channel or void between ridge portions. The channel has outer dimensions complementary to the diameter of the cord so that a portion of the earphone cord when the cord is bundled can fit within the channel when in an assembled configuration, increasing the gripping action and helping to anchor the movement of the enlarged body portion relative to the bundle of cord during the assembled configuration.

The enlarged body portion has a passageway that has a central axis that extends in an elongate direction towards the central region of the elongate body; the passageway extends from an exit opening on enlarged body portion back wall to the entry opening on enlarged body portion face/front wall. The passageway is thus in the form of a passageway through the ridge portions and through the center of support portion. The passageway is partially open in the channel between the ridge portions. Since a portion of the passageway is open, a portion of the plug housing or cord inserted through the passageway is visible in this portion of the passageway when in an attached or assembled configuration with the earphones.

To shorten the desired length of a cord, the same process as outlined above is followed. The elongate length of the band, and the distance between the first opening and the second opening, is sized to be long enough to partially wrap around a portion of fully coiled bundle for the storage use case, but short enough to also partially wrap around a bundle of fewer coils for the shortening use case. If the distance between the first opening and the second opening is greater than the circumference of the coiled bundle, it may not be able to securely retain the bundle. The distance is helpful in allowing the band to maintain a tensioned state during securing.

In operation in an assembled configuration, to unsecure the cord management organizer, the user simply slides the second end over the housing and plug, which releases the bundle from its assembled configuration. The user simply pulls the plug end of cord and the bundle unravels from its coiled state, thereby the earphones are readily useable without the need to unwind.

To tether the band to an object (e.g. zipper pull or button) on the user's clothing, the user slides the device to a position on the cord proximate to the Object, then inserts the object through the second (plug retention) opening. The elastic property of the band's material will allow the second opening to stretch to accommodate a larger object, then its resilience and circumferential tension will hold the band to the object, thereby retaining the cord near to the user, lessening the probability of a loosely dangling cord becoming entangled on another object while also serving the function of holding the cord in place if the user should remove the earphones speakers from their ears, obviating the need to hold them in hand until the ready to use them again. To untether the device, the user simply slides it off the object.

Advantages of one or more of the embodiments include:

1. being able to organize the coiled cords in a compact, tangle-free way.
2. allowing shortening the cord to a desired length.
3. enabling the cord management organizer to be releaseably fastenable—without clips or conventional, mechanical fasteners—by a user to articles such as buttons or zippers on clothing to help with any of the following objectives: to reduce the risk of entanglement of the loose, dangling cord with other objects while in use; or, to help prevent the earphones from dropping to the ground if the earphones inadvertently become dislodged from their secure position in the user's ears; or, to support the earphones if the user temporarily removes the earphones' speakers from the user's ears and does not want to hold the dangling earphones.
4, being attachable to the earphone's cord so that the organizer is always available when needed and not misplaced when not in use.
5. providing a "quick release" from the assembled configuration eliminating the need to unwind the cord.
6. providing a cord management organizer fits (i.e. "one-size-fits-all") virtually all accessory cords in a certain category (e.g. ones with a 3.5 mm plug, or charger for iPhone™ 6), and does not require integral attachment at the time of manufacturing the earphones.
7, providing a cord management organizer that can be formed as a unitary (made from one piece of material) device for lower costs, ease of manufacture and a clean, aesthetically pleasing appearance.
8. avoiding potentially damaging stress on the cords during use.
9. resisting axially sliding movement of the device relative to the cord—while still allowing movement by the user when desired, either to remove the device, or to adjust its placement on the cord.
10. eliminating the need for attached, integral fasteners (for forming a complete, encircling loop to secure coiled cords or for attaching the device to the cord), such a hook and loop, hook and aperture, tongue and aperture, snaps or others.
11. providing a cord management organizer that is very compact in size, such that the elongate length of the band is less than the circumference of the fully coiled bundle of cords it is to secure, to minimize material cost, weight, and bulk, while improving the aesthetics,
12. providing a cord management device that is compact (not bulky), lightweight, compressible, flexible and unobtrusive such that it lessens the likelihood of either interference with the user or becoming potentially entangled with the user (or objects in the user's or device's) surroundings while the earphones and the device are in use, or the device and the earphones are stowed in the user's pocket or other confined place.
13. eliminating the need for unwinding so that the user has quick access to the earphones if they are in a stored state with the device.
14. providing a cord management device that is available in a variety of colors to identify a particular set of earphones—a useful feature, for example, to differentiate identical earphones within a given family.

BRIEF DESCRIPTION OF THE DRAWINGS

Preferred exemplary embodiments will hereinafter be described in conjunction with the appended drawings, wherein like designations denote like elements, and wherein:

FIGS. 9*a*-9*c* are top views illustrating the process for attaching a cord to the cord management organizer of FIG. 1.

FIG. 10 is a perspective view of a user's hands coiling the cord.

FIG. 11 is a perspective view of a user's hand holding the coiled cords against the cord management organizer of FIG. 1.

FIG. 15 is a perspective view of the cord management organizer of FIG. 1 illustrating the tethering feature of the cord management organizer on a user's zipper pull.

FIG. 16 is a top view of the cord management organizer of FIG. 1 illustrating its application to another type of cord a power/data cord.

FIG. 17 is a perspective view of the cord management organizer of FIG. 1 in an assembled configuration illustrating its use to secure the power/data cord shown in FIG. 16.

FIG. 18 is a front view of a die cut sheet of closed cell rubber—used to manufacture a second embodiment of a cord management organizer constructed in accordance with the invention.

FIG. 19 is a side view of the second embodiment of the cord management organizer made using the sheet material shown in FIG. 18.

FIG. 20 is a bottom view of the cord management organizer of FIG. 19.

FIG. 21 is a front view of the cord management organizer of FIG. 19.

DETAILED DESCRIPTION

Figure 1:
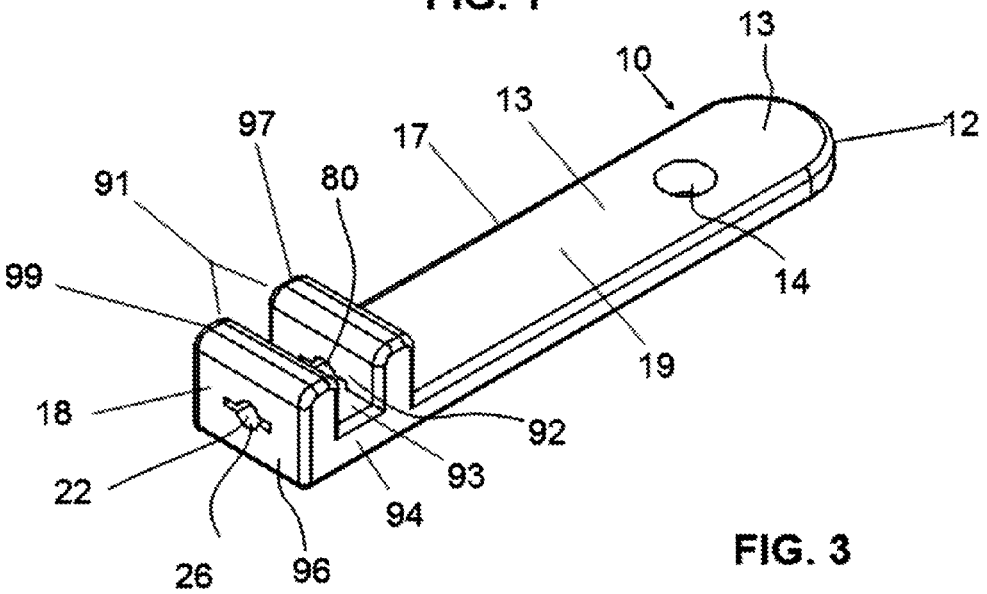
FIG. 1 is a perspective view of a first embodiment of a cord management organizer constructed in accordance with the invention.

FIGS. 1-17 depict a first embodiment 10 of a cord management organizer constructed in accordance with the invention. Of these, FIGS. 1-8 show various views perspective (FIG. 1 and FIG. 8), first end (FIG. 2 and FIG. 8), second end (FIG. 3), side (FIG. 4), top (FIG. 5) and bottom (FIG. 6)—of the cord management organizer 10.

The cord management organizer 10 is made from molded silicone, but any other suitable elastomer such as thermoplastic elastomer (TPE) may be used. The manufacturing process to make organizer 10 can be injection molding, compression molding, or any other appropriate method for forming the selected material into the desired final shape.

The cord management organizer 10 may be used with any suitable set of earphones and generally will fit any earphones of a given class (e.g., 3.5 mm plug), which is an advantage since it does not require manufacturing multiple versions to fit diverse configurations from multiple manufacturers. It should be noted that earphones, earbuds, and headphones are all names for the same general class of audio/phone accessories used to listen to audio input or to make phone calls. The cord management organizer 10 is independent, separate and removable from the cord of the earphones. While the plug that is illustrated in subsequent drawings is a plug for a set of earphones, the cord management organizer 10 could be adapted to fit any accessory cord and associated plug for a computing and portable electronic device. Depending on the requirements of a particular application (e.g., the cord and plug end dimensions), the dimensions and material(s) used for the organizer 10 can be adjusted as needed or desired for that particular application.

The cord management organizer 10 has an elongate body 17 extending from the first end 18 to the second end 12 with a plug retention opening 14 proximate the second end 12. Located at the first end 18 is an enlarged body portion 91, which has a pair of ridge portions 97 and 99, integrally connected by a support portion 93. The enlarged body portion 91 includes a passageway 80 extending lengthwise through both ridge portions 97, 99. Although the enlarged body portion 91 is shown in the illustrated embodiment as including the terminal face (margin) of the organizer 10 at first end 18, it will be understood that in other embodiments it may be located somewhat inboard of (i.e., proximate) the first end 18. Thus, the enlarged body portion is located adjacent (i.e., either at or proximate) the first end 18.

Figure 4:
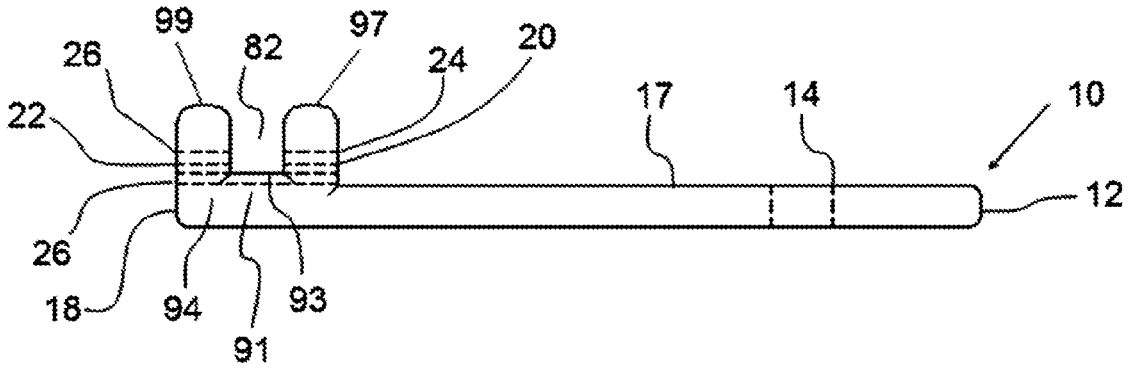
FIG. 4 is a right side view of the cord management organizer of FIG. 1.

The elongate body 17 of the cord management organizer has a planar conformation that extends lengthwise from the second end 12 past its central region 19 to where it meets the enlarged body portion 91. Along this length the body 17 includes first face (lower surface) 16 and a second face (upper surface) 13. At the enlarged body portion 91, the height of the support portion 93 is less than the height of ridge portions 97 and 99 effectively creating a channel 82 between ridge portions 97 and 99. As shown in FIG. 4, the height of support portion 93 is greater than that of elongate body 17 at its central region 19 and second end 12, but could be equal or less.

The passageway 80 in the enlarged body portion 91 extends from a cord entry opening 20 in the surface 95 of first ridge portion 97 to a cord exit opening 22 in the surface 96 of second ridge portion 99 at the first end 18. It has a central axis that extends from the first end 18 towards the central region 19 in an elongate direction (the lengthwise direction of the body 17). Thus, passageway 80 includes two portions 24 and 26 that extend through the ridge portions 97 and 99, respectively, as well as an open portion that extends over the center of support portion 93 between the ridge portions. Since a portion of the passageway 80 is open, a portion of the plug, plug housing or cord inserted through the passageway 80 is visible in this portion of the passageway 80, as illustrated in FIG. 9. The geometry of the enlarged body portion 91 with ridge portions 97 and 99, passageway 80, support portion 93 and elastic material characteristics are designed to achieve the following objectives:

1. Allow easy insertion and removal of the plug, plug housing and cord.
2. Maintain the cord management organizer 10 in a static position when in an attached configuration, so it does not slide up and down the cord, while still allowing manual movement for the tethering feature. See FIG. 15.
3. Maintain the cord management organizer 10 in a relatively static position when it is in an assembled configuration, so that it resists movement in the tensioned state,
4. Maintain axial alignment of the cord management organizer 10 with the cord when the cord management organizer 10 is attached to the cord.
5. Limit the angle of the cord bending near the plug housing to lessen the stress on the cord when in an assembled configuration.

It should be noted that features that allow easier insertion and removal of the plug and plug housing generally make it more difficult to achieve objectives 2 and 3.

The geometry of the enlarged body portion 91 combined with the elastomer material in at least some embodiments achieve the above desired objectives in the following ways:

1. The ridge portions 97 and 99 grip the bundle of coiled cord and limit the circumferential movement around the coiled cord when the cord management organizer 10 is in an assembled configuration helping to keep the enlarged body portion 91 anchored in a relatively static position in relation to the coiled cord. This is helpful in keeping the cord management organizer 10 in an assembled configuration that resists unbundling around the coiled cord. See FIG. 13 for an illustration of the assembled configuration.
2. The ridge portions 97 and 99 allow the enlarged body portion 91 to bend more readily in a curvilinear fashion to encircle the coiled cord. When the enlarged body portion 91 bends in a curved fashion during the assembled configuration, the ridge portions 97 and 99 bend toward each other, providing the added benefit of increasing the grip on a portion of the coiled cord that extends through the channel 82. See again FIG. 13 and its corresponding description farther below. Since the enlarged body portion 91 is attached to the cord 34 near the plug housing 46, an area where excessive stress can potentially wear or damage the cord, the ridge portions by griping the cord and by their geometry limit the angle of curvature of the cord passing through the passageway 80, thereby limiting the stress on that portion of the cord 34.
3. The ridge portions 97 and 99 are sized in thickness and spaced a sufficient distance apart in parallel alignment to provide a sufficient length for passageway 80 to maintain axial alignment of the cord management organizer 10 with the cord when the cord management organizer 10 is attached to the cord. The passageway 80 is also in substantial axial alignment with the elongate body 17.
4. Easier insertion and removal of the plug and plug housing is achieved by having the passageway 80 through the ridge portions 97 and 99, with an exposed passage portion between the ridges at channel 82, thereby lessening the surface area of the passageway 80 in contact with the plug and plug housing decreasing both the sliding friction and the circumferential clamping force of the silicone elastomer material of the enlarged body portion 91 on the plug and plug housing. Additionally, the geometry of passageway 80, which has circularly shaped center portion 21 with the addition of two generally rectangular shaped insertion slots 30 and 31 on opposing lateral sides of circularly shaped center portion 21, collectively form a wider passageway, which facilitates easier insertion and removal of the plug housing. These features of passageway 80 are discussed in further detail below.
5. Since at least one dimension of the inside diameter of the passageway 80 is equal to or smaller than the outside diameter of the cord, the elastic material of the ridge portions 97 and 99 that forms the passageway exerts a circumferential, or (depending on the passageway 80 geometry) a partially circumferential, clamping force on the cord helping to maintain the cord management organizer 10 in a relatively static position when it is in an assembled configuration, so that it resists movement in the tensioned state, while also maintaining it in a static position on the cord when in an attached configuration (when attached to the cord), as shown in FIG. 9. Additionally, where silicone is used, it grips the cord helping to maintain the static position. The vertical dimension of the passageway 80 (i.e., the diameter of the circular cross-sectional part of the passageway) is sized equal to or smaller than the diameter of the cord, while the horizontal dimension (that includes slots 30, 31) is significantly larger than the diameter of the cord (see FIGS. 2 and 8 for passageway illustration), and is slightly smaller than the outside diameter of the plug housing (see FIG. 9 for plug illustration). The thickness of the ridge portions 97 and 99 (discussed below), is sized to allow easy insertion through the passageway 80 while also providing sufficient elastic clamping force on the cord and sufficient resistance to bending. If is the ridge portions are too thick, it is difficult to insert or remove the plug due to increased friction and clamping force.

The enlarged body portion 91 has side walls, 92 and 94 (FIGS. 4 and 7), shared with ridge portions 97 and 99 and support portion 93, an enlarged body portion front wall 95 (FIG. 3) on ridge portion 97, and an enlarged body portion end wall 96 on ridge portion 99 at first end 18. The enlarged body portion 91 has three top wall surfaces: top surface 87 of ridge portion 97, top surface 89 (FIG. 7) of ridge portion 99 and top surface 86 of support portion 93. The enlarged body portion 91 has a bottom wall 90 (shown in FIG. 6) in the same plane as the first face 16 (shown in FIG. 6) of the elongate body 17. The ridge portions 97 and 99 have a height defined as the distance between top surface 87 (for ridge portion 97) and top surface 89 (for ridge portion 99) and the bottom wall 90 of enlarged body portion 91. The heights of the ridge portions 97 and 99 are substantially the same, but can be different. These heights should be sufficient to allow for the passageway 80 to be formed through, while allowing a sufficient amount of material between the passageway 80 and the respective top surfaces 87 and 89 to maintain the structural durability of the passageway 80.

In the embodiment of cord management organizer 10 shown, the elongate body 17 is made from 30 durometer hardness (Shore A) "ELASTOSIL™ R 401/30 S" silicone, supplied by Wacker Chemical. The height of the support portion 93 may be 3.25-4.25 mm. The following dimensions also assume this same material.

Figure 5:
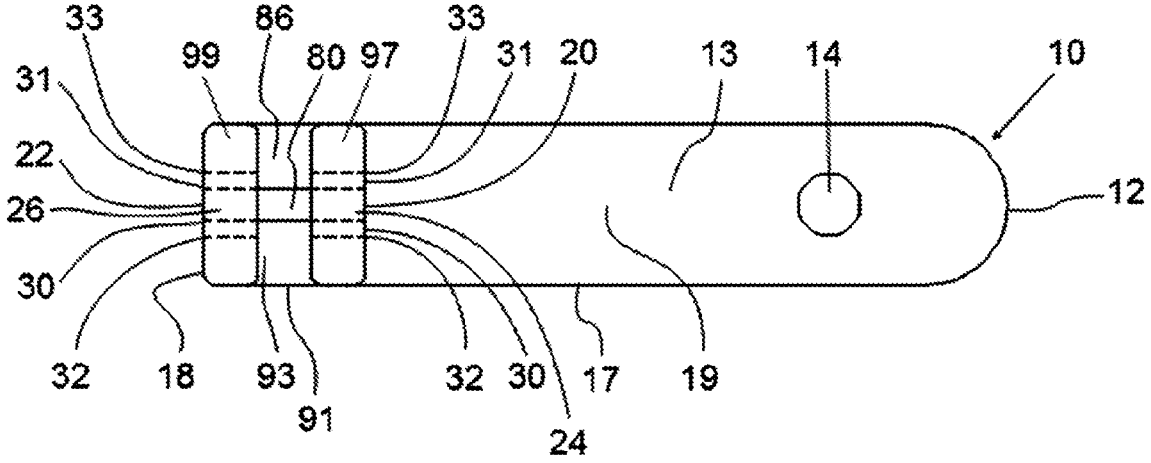
FIG. 5 is a top view of the cord management organizer of FIG. 1.

The height of ridge portions 97 and 99 is greater than the thickness of the elongate body 17 at the central region 19 (FIG. 5). The thickness of the elongate body 17 at the central region 19 is defined as the distance from the generally planar second face 13 (FIG. 5) to the first face 16 (shown in FIG. 6) and in one embodiment is 2.25 mm.

The dimensions of the passageway 80 at the exit opening 22 are outlined in FIG. 8's description below and are, but need not be, uniform along the length of the passageway as it extends through the ridge portions 97 and 99. In other embodiments, the previously mentioned objectives of easy insertion of the plug and static position on the cord may be achieved by various geometries of the cord openings 20, 22 and passageway 80, which may be different from the geometry in FIG. 8. Various geometries or combinations of geometries, including rectangular and various cylindrical polygons with or without ribs are possible. The passageway may also have non-uniform diameter, width and height dimensions through the passageway provided the geometry achieves the objectives of ease of insertion and maintaining the relative static position on the cord in the attached configuration illustrated in FIG. 9*c*. One or more dimensions may be smaller than the standard 3.5 mm earphone cord, white other dimensions may be slightly smaller than the dimensions of the earphone plug housing. By using an at least somewhat elastic material and having one dimension equal to or smaller than the cord and one dimension slightly smaller than the dimension of the plug housing, the objectives of both maintaining the static position on the cord and allowing easy insertion and removal of the plug and plug housing can be achieved.

In one embodiment the dimensions of the body portion 91 is 6.75 mm high by 9.0 mm wide, equal to the width of the elongate body 17, by 9.0 mm deep as defined by the distance from the enlarged body portion front wall 95 to the enlarged body portion back wall 96. The distance from the enlarged body portion back wall 96 to the channel 82 is 3.0 mm, making the thickness of the upper portion of the ridge portion 99 3.0 mm; the distance from the ridge portion 99 to the ridge portion 97 is 3.0 mm, making the channel 82 3.0 mm wide, and the distance from the channel 82 to the opposing side of ridge portion 97, which is also the enlarged body portion face 95, is 3.0 mm. The above dimensions are for an embodiment using 30 durometer ELASTOSIL™ R 401/30 S silicone supplied from Wacker Chemical. The above dimensions achieve the right performance for the application and different materials with different material properties may require varying dimensions to achieve the right performance.

Figure 2:
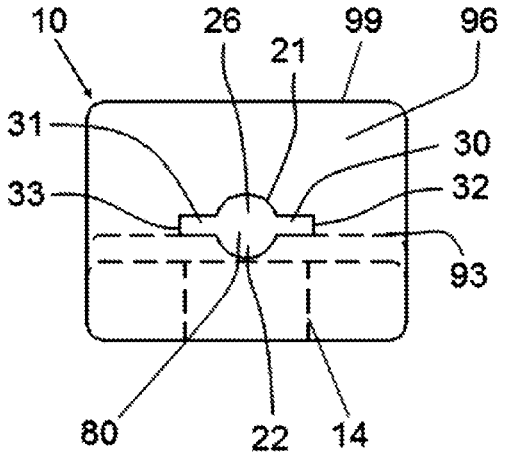
FIG. 2 is first end view of the cord management organizer of FIG. 1.

FIG. 2 shows a first end view of the cord management organizer 10 from FIG. 1. Its vantage point is from the first end 18 illustrating the geometry of the cord exit opening 22 in the back wall 96 of enlarged body portion 91. As indicated in FIGS. 2-5, the passageway 80 runs through ridge portions 97 and 99 and through the center of support portion 93 of the enlarged body portion 91. FIG. 2 also illustrates the geometry of cord exit opening 22, which has circularly shaped center portion 21 with the addition of two generally rectangular shaped insertion slots 30 and 31 and delimited by respective insertion slot sidewalk 32 and 33 on opposing lateral sides of circularly shaped center portion 21, collectively forming a wider passageway 80.

Figure 3:
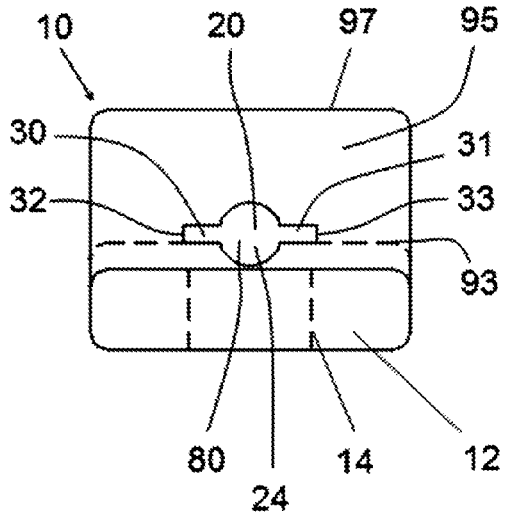
FIG. 3 is a second end view of cord management organizer of FIG. 1.

FIG. 3 shows a second end view of the cord management organizer 10 from FIG. 1. Its vantage point is from the second end 12 illustrating cord entry opening 20 positioned on the front wall 95 of ridge portion 97 of enlarged body portion 91.

Figure 13:
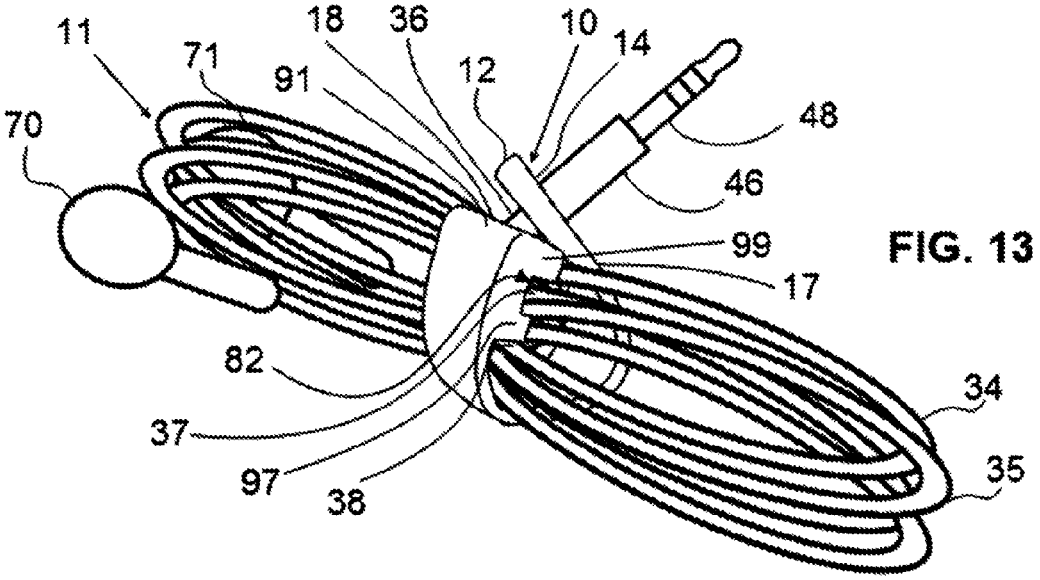
FIG. 13 is a perspective view of the cord management organizer of FIG. 1 in an assembled configuration with earphones.

FIG. 4 shows a side view of the cord management organizer 10 from FIG. 1 from first end 18 to second end 12 with elongate body 17, plug retention opening 14 and enlarged body portion 91 at the first end. The enlarged body portion is comprised of ridge portion 99 at second end 18 integrally connected to support portion 93, which is integrally connected to ridge portion 97. The enlarged body portion 91 has a side wall 94. The void or space between ridge portion 97 and ridge portion 99 and above support portion 93 is the channel 82, which functions to grip the cord 34 (shown in FIG. 13 which illustrates the assembled configuration) helping to resist the movement of the enlarged body portion 91 relative to the bundle of cord 35 (FIG. 13). Slot side walls 32 and 33 are illustrated by dashed lines through ridge portions 99 and 97 substantially parallel to passageway 80 which begin at cord entry opening 20 and ends at cord exit opening 22.

FIG. 5 is a top view of the cord management organizer 10 in FIG. 1. It shows the generally planar second face 13 which extends from second end 12, with plug retention opening 14 proximate the second end 12, to the ridge portion 97 of enlarged body portion 91. Also, it shows the top wall 86 of support portion 93; the top wall 86 is bisected by passageway 80 separating the top wall 86 into two portions. The elongate body 17 has a central region 19 located between cord entry opening 12 and plug retention opening 14.

Figure 6:
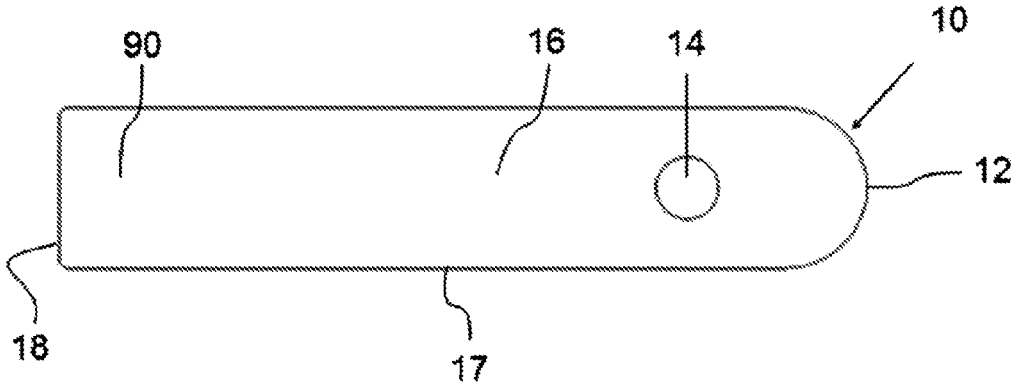
FIG. 6 is a bottom view of the cord management organizer of FIG. 1.

FIG. 6, is bottom view of the cord management organizer 10. It shows the generally planar first face 16 which extends from first end 18 to second end 12 with plug retention opening 14 proximate the second end 12. Also, it shows the bottom wall 90 of enlarged body portion 91, which is in the same plane as a planar first face 16.

Figure 7:
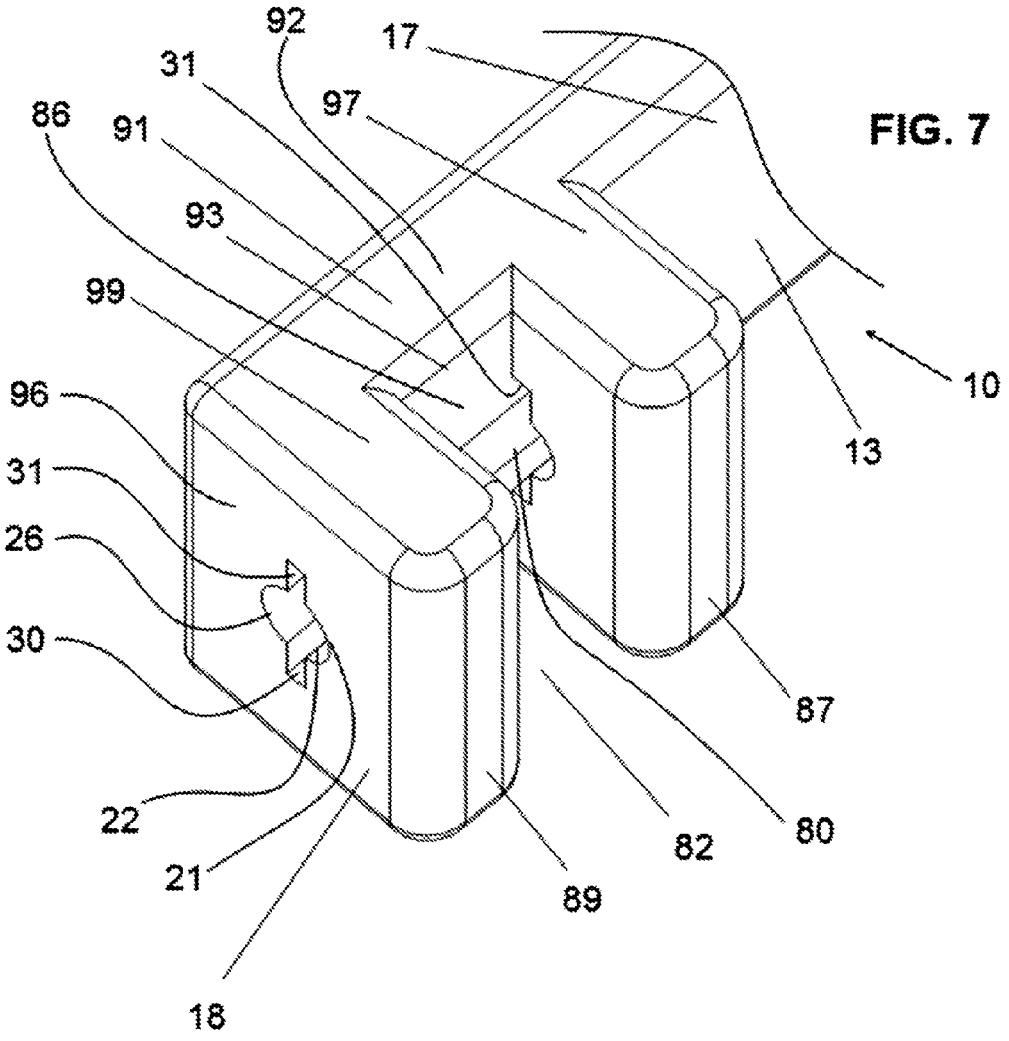
FIG. 7 is a perspective view of the cord management organizer of FIG. 1 showing an enlarged view of the enlarged body portion at its first end.

FIG. 7 is an enlarged fragmentary view that provides a different perspective view of the enlarged body portion 91 of the cord management organizer 10.

Figure 8:
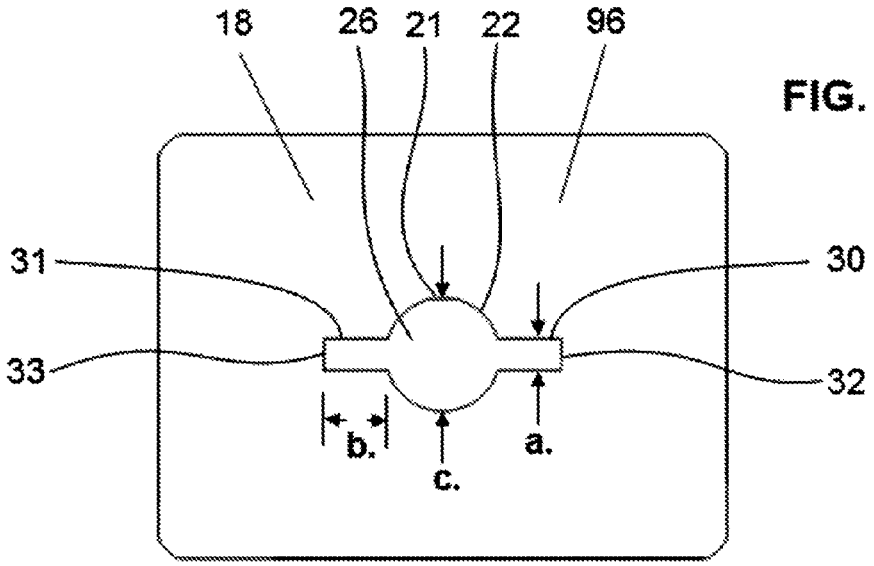
FIG. 8 is a second end view as in FIG. 2 showing the dimensions of a cord passageway extending through the cord management organizer of FIG. 1.

FIG. 8 is a back view of the cord management organizer in FIG. 1 illustrating the geometry of the passageway 80 at the an exit opening 22 on enlarged body portion 91 back wall 96. FIG. 8 illustrates that passageway 80 passes through ridge portions 97 and 99, and through the center of support portion 93 of the enlarged body portion 91, thereby forming the two passageway portions 24 and 26. FIG. 8 also illustrates the geometry of passageway 80, which has circularly shaped center portion 21 with the addition of two generally rectangular shaped insertion slots 30 and 31 on opposing lateral sides of circularly shaped center portion 21, collectively forming a wider cord opening. The width of cord opening 20 is defined as the distance from insertion slot 30 side 32 to insertion slot 31 side 33. The height of slot 30 and slot 31 is the same and is the distance between the arrows labeled "a". FIG. 8 also shows the start and end points between the arrows labeled "c' for measuring the passageway 80 diameter of center portion 21. The opening width for cord opening 20 in the illustrated embodiment is approximately 3.8 mm, which is the width of both slots plus the diameter of center portion 21. The diameter of the center portion 21 is 1.8 mm, which is slightly less than or equal to the majority of cord diameters for earphones. The slot height is 0.5 mm.

FIG. 9 is a top view illustrating attaching cord management organizer 10 in FIG. 1 to the cord 34. FIG. 9*a*. illustrates the enlarged body portion 91 is configured such that the plug end of the cord 34 (comprising plug 48 and plug housing 46) is insertable into the passageway 80 at cord entry opening 20 along a path of movement starting at the central region 19 across the second face 13 with the plug 48 being inserted through the cord entry opening 20 (FIG. 9*a*) and exiting the cord exit opening 22 (FIG. 9*b*.) so that at least a portion of the plug housing 46 extends out of the cord opening 22 past the first end 18 to thereby define an attached configuration of the organizer and electrical cord as illustrated in FIG. 9*c*. The enlarged body portion 91 is illustrated positioned on the cord 34, proximate the plug housing 46, after the plug 48 and plug housing 46 were inserted fully through the passageway 80. As illustrated in FIG. 9*c*, a section of the cord 34 that begins at the plug housing 46 extends from the cord entry opening 20 along the second face 13 of the elongate body 17 towards the central region 19.

The passageway 80 has a diameter when the material is in a relaxed state that is smaller than at least a portion of the plug housing 46, with the elasticity of the material being sufficient to permit expansion of the passageway 80 to a size that allows the plug housing 46 to pass through the expanded passageway, whereby the cord management organizer 10 and cord 34 can be placed into the attached configuration as illustrated.

As can be appreciated from FIGS. 9*a*-9*c*, the enlarged body portion 91 with its passageway 80 constitutes an end feature of the elongate body 17 that interconnects the body 17 to the cord 34 at its plug end so that the interconnection of the body with the cord biases the organizer into at least partial alignment of the elongate body 17 with a section of the cord 34 that extends from the plug end. This alignment is shown in FIGS. 9*b* and 9*c*, as well as FIG. 22 in connection with the second embodiment discussed below.

FIG. 10 is a perspective view of an end user's hands 50 and 51 coiling the cord 34 in the first step of storing the cord in an assembled state. The cord 34 is part of earphones 11, which comprise the entire electronic accessory device from plug 48, plug housing 46, cord 34 to speakers 70 and 71. To coil the cord 34, the cord management organizer 10 is placed in a position parallel to the user's fingers with the first end 18 placed under the user's thumb with the second end 12 pointing in the direction of the user's fingers. The cord 34 is wrapped around the user's elongated fingers and cord management organizer 10.

FIG. 11 is a perspective view of an end user's hand holding the coiled cords against the cord management organizer 10. After coiling the cord in the first step, the second step is to securely hold the bundle of coiled cord 35 against the cord management organizer 10 as shown by pinching between the thumb and forefinger of hand 51.

Figure 12:
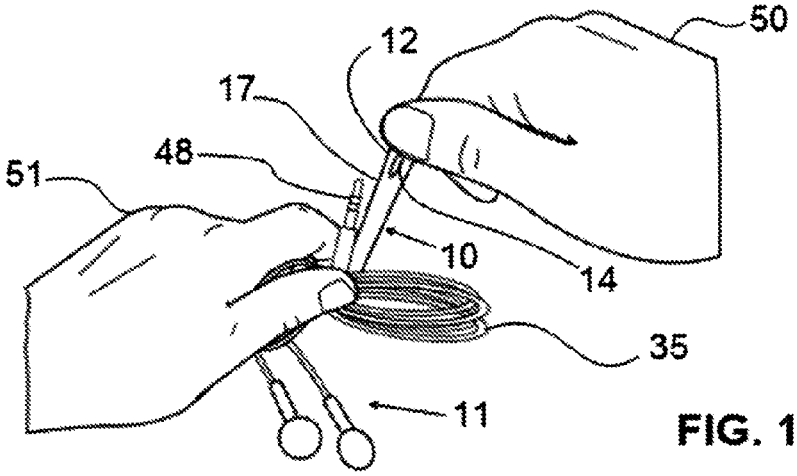
FIG. 12 is a perspective view of a user's hands holding the coiled cords against the cord management organizer of FIG. 1 while stretching the elongate body of the organizer.

FIG. 12 is a perspective view of an end user's hands holding the coiled cord against the cord management organizer 10 while stretching the elongate body. In the third step, the user wraps the cord management organizer 10 around the bundle of coiled cord 35, then while pinching the cord management organizer 10 against the bundle of coiled cord 35 with the user's left hand 51, the user's right hand 50 pulls the cord management organizer by grabbing the second end 12 and stretches the elongate portion 17 until the plug retention opening 12 is positioned over the plug 48. Then the user secures the plug retention opening 14 over the plug 48 and plug housing 48 thereby forming an assembled configuration.

FIG. 13 is a perspective view of the cord management organizer 10 in an assembled configuration with earphones 11. The elongate body 17 is flexible and elastic to permit wrapping of the elongate body 17 about the bundle 35 of the cord 34. The plug housing 46 has been inserted through plug retention opening 14 to secure the second end 12. The elongate body portion 91 with ridge portion 97 is shown gripping cord 34 portion 38 in channel 82 and ridge portion 99 is gripping cord portion 37 of cord 34 to facilitate the static position of the elongate body portion 91 on the cord 34 as the cord management organizer 10 is in a tensioned or stretched state around the cord bundle 35. The second end 12 is in relatively close proximity to first end 18 in the assembled configuration with a cord portion 36 shown between first end 18 and second end 12, completing the loop in cooperation with the cord management organizer 10.

The channel 82 has outer dimensions complementary to the diameter of the cord so that one or more lengths of a portion of the earphone cord when the cord is bundled can fit within the channel 82, when in an assembled configuration, increasing the gripping action and helping to maintain the static position during the assembled configuration. Since the cord management organizer 10 is made from an elastomer that bends relatively easily at the thicknesses sized for the ridge portions 97 and 99, the support portion 93 functions to support the ridge portions 97 and 99 in substantially transverse alignment to the elongate body 17 when the enlarged body portion 91 is subject to the stress of inserting or removing the plug and plug housing, thereby facilitating easier removal or insertion. Additionally, maintaining the transverse alignment of the ridge portions 97 and 99 helps them achieve their function of anchoring the enlarged body portion 91 against circumferential movement relative to the bundle of cord 35 when in an assembled configuration. If the ridge portions easily bend, they can more easily lose their grip against the coils of cord (substantially in parallel alignment with the ridge portions), thereby allowing the ridge portions to more easily slip over the coils of cords, causing the first end 18 to slip on the cord losing its static position, and potentially loosening the tension of the cord management organizer 10 in its partial loop formation around the coiled cord. Also, when the ridges bend significantly, the channel 82 is not maintained, diminishing the gripping action of the ridge portion 99.

Figure 14:
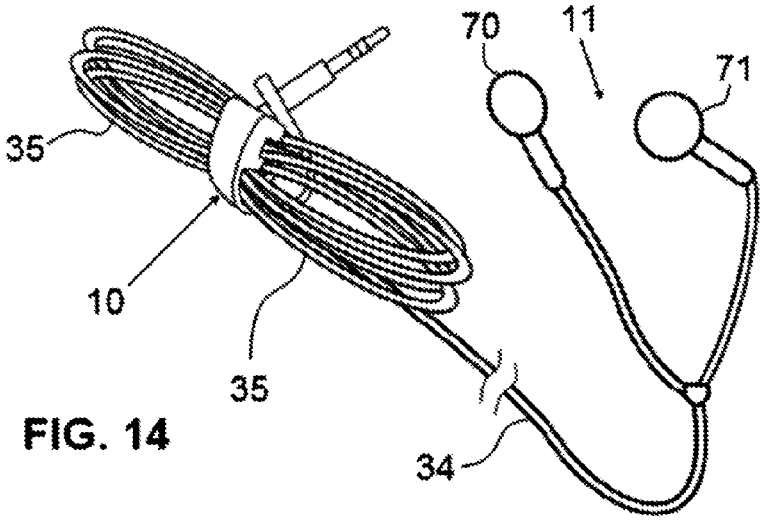
FIG. 14 is a perspective view of the cord management organizer of FIG. 1 in an assembled configuration with earphones illustrating the shortening function.

FIG. 14 is a perspective view of the cord management organizer 10 from FIG. 1 in an assembled configuration with earphones 11 illustrating the shortening function. To use the cord management organizer to shorten a portion of the cord 34, the user coils the desired length of cord that is not needed into a bundle 35, leaving a length of the cord 34, then follows the same process to secure the bundle 35 as outlined previously. Also shown in FIG. 14 are earphone speakers 70 and 71.

FIG. 15 is a perspective view of the cord management organizer from FIG. 1 illustrating the tethering feature of the cord management organizer on a user's zipper pull 60. The zipper could be on a user's clothing, backpack or other article on the user. In place of zipper, a button (not shown) of complementary dimensions to the plug retention opening 14 could be used in the same manner. The cord management organizer 10 has been slid up the cord 34 from its position adjacent the plug housing 48 (not shown in this drawing) to a desired position. The plug retention opening 14 has been slid over the zipper pull 60 of the user. The silicone rubber material of the cord management organizer 10 is relatively elastic allowing the expansion of the plug retention opening 14 by stretching, facilitating the easy slipping over the zipper pull 60. The bulge 15 proximate second end 12 illustrates the expansion of the diameter of the plug retention opening 14. Due to combination of the circumferential clamping force of the tensioned plug retention opening 14 and the griping quality of the silicone inside of the plug retention opening 14, the cord management organizer 10 remains releaseably attached to the zipper pull 60, until the user applies a small force to remove it. The function of attaching the cord management organizer to the user's zipper pull 60 to keep the dangling cord 34 relatively close to the user to decrease the likelihood that the dangling cord 34 will become entangled with other objects in the user's environment. Also, another function is to allow the user to remove the speakers 70 and 71 (not shown in FIG. 15) from the user's ears and let than dangle without the need for the user to hold them. This is a desirable feature, for example, if the user encounters another person while listening to the earphones, and wants to talk with that person and does not want to have to hold the dangling cord 34 and speakers 70 and 71, or risk dropping them potentially damaging them. Also, the tethering function serves to support the majority of the cord, thereby decreasing the pull of the cord on the earphone speakers, which are generally only loosely held in position in the user's ears. Users of earphones frequently complain about the cord tugging their earphone speakers out of their ears in use, largely due to the weight of the cord. This tethering function is especially useful if the user is engaging in a vigorous activity, like running or biking, which risks the earphone's speakers 70 and 71 slipping out of their secure position in the user's ears and dropping to the ground or worse becoming entangled in a bicycle's gears, potentially damaging them. Additionally, by incorporating this function into the cord management organizer, the user does not need to purchase or carry another device to perform this function. If the cord management organizer is being used for the shortening function, another cord management organizer may be attached to the cord to perform the tethering function.

FIG. 16 is a top view of the cord management organizer from FIG. 1 illustrating its application to another type of cord—a Lightning™ charging cord for an Apple™ iPhone™ 5 or 6. While the cord management organizer 10 is the same size as one for an earphone, it works for the iPhone™ charger as well since the dimensions of charger's plug housing 47 and cord 39 are only slightly larger than those of earphones. The cord management organizer 10 is illustrated in use removably attached to a cord 39 of the charger. The cord management organizer 10 is attached in the same manner as described for the earphones in FIG. 9. As shown in FIG. 16, the cord management organizer 10 is located proximate the plug housing 47 prior to use tier either performing the function of shortening or securing the cord tier storage.

FIG. 17 is a perspective view of the cord management organizer in an assembled configuration from FIG. 1 illustrating its use to secure a bundle 55 of cord 54 for the Apple™ iPhone™5 and 6 charger that includes an electrical plug 58. The process for coiling the cord and securing the cord management organizer is the same as described for earphones in FIGS. 10-14.

Although the embodiments disclosed in FIGS. 1-17 specify an elastomer 30 durometer silicone (Hardness Shore A) by the brand name ELASTOSIL™ R 401/30 S supplied from Wacker Chemical, elastomers within the ranges specified below may also be suitable for the cord management organizer. Table I below outlines the elastomer characteristic and the acceptable ranges for each characteristic and measure. There is a broad range and an intermediate range with the latter range more closely specifying suitable characteristics. The characteristics of a different material may require altering key dimensions of the organizer to achieve the desired performance. For example, the width and thickness of the elongate body may be decreased with certain harder elastomers with a lower measure of elongation at break, as the material may not be as elastic as needed. Additionally, the geometry or dimensions of the enlarged body portion 91, ridge portions 97 and 99, support portion 93, and passageway 80 as well as the plug retention opening 14 may need to be adjusted to achieve the right balance of insertion ease with circumferential clamping force on the cord.

TABLE I

| Elastomer Characteristic | Broad Range | Intermediate Range |
|---|---|---|
| Hardness Shore A | 10-60 | 25-50 |
| Elongation at break % | 100-1400 | 250-1200 |

FIG. 18 is a front view of a die cut sheet of material 111—nylon covered, closed cell rubber—used to manufacture a second embodiment of a cord management organizer which is shown in FIG. 19-22. It illustrates the die cut piece of material of elongate, shape with a first end 118 and a second end 112 and tabs or corners 160 and 162 at the first end before the corners 160 and 162 are affixed together, such as by sewing. A suitable material is closed cell, nylon covered, foam commonly referred to as closed cell rubber, although other suitable materials will become apparent to those skilled in the art. The approximate dimensions of the die cut piece of closed cell rubber shown is 45 mm in length with a width of 10 mm for the majority of the elongate body, increasing to 15 mm at the portion at the first end 118. The plug retention opening 114 can be 30 mm from the edge of the first end 118. The diameter of the plug retention opening 114 is 3-4 mm. The benefit of a relatively small opening is lessening the likelihood of the opening becoming caught or snagged on an object in the user's environment. Other embodiments will have dimensions and/or materials other than described depending on the particular application.

FIG. 19 is a side view of the cord management organizer in FIG. 18 manufactured from the die cut material 111 shown in FIG. 18. The elongate cord management organizer 110 shows the first face 116 and the second face 113. The first end 118 has an entry aperture 120 and an exit aperture 122, which forms a passageway 180 between entry aperture 120 and an exit aperture 122. The passageway 180 is formed during manufacturing by affixing the two opposite corners 160 and 162 of the first end 118 of the device and the passageway 180 is illustrated by the dashed lines. The corners are affixed, such as by sewing in the area of 121 parallel to the dashed lines of passageway 180. Another result of affixing the two opposite corners at the first end 118 to form the passageway 180 is the creation of an enlarged body portion 191, which extends upwardly from the plane of the remainder of the sheet elongate body 117 and has a transverse alignment to that plane. The enlarged body portion functions to anchor the bundle of cord in an assembled configuration in a similar way to the enlarged body portion described in other embodiments.

FIG. 20 is a bottom view of the cord management organizer 110. It shows the first face 116 which extends from first end 118 to second end 112 with plug retention opening 114 proximate the second end 112. Also, it shows the enlarged body portion 191 proximate first end 118.

FIG. 21 is a front view of the cord management organizer 110. Its vantage point is from the second end 112 illustrating cord entry aperture 120 positioned on the enlarged body portion 191. Cord entry aperture 120 is illustrated by the oblong circular in shape and formed due to the folding of and affixing of the two corners 160 and 162 of the first end 118 of the die cut material 111 shown in FIG. 18.

Figure 22:
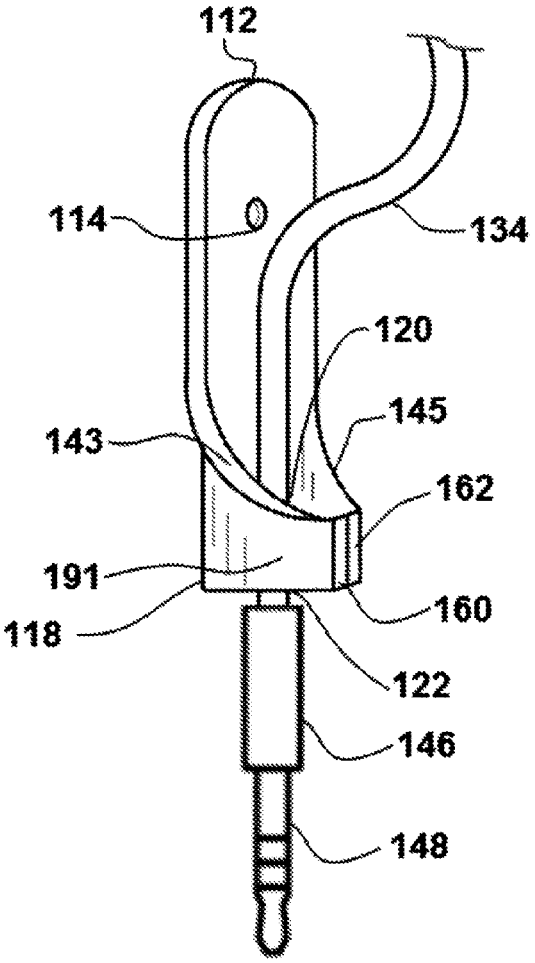
FIG. 22 is a perspective view of the cord managementorganizer of FIG. 19.

FIG. 22 is a perspective view of the cord management organizer 110 in an attached configuration. The cord management organizer 110 is attached to an earphones' cord 134 proximate the plug housing 146. The plug 148 and plug housing 146 have been inserted into the passageway 180 through cord entry aperture 120 and out the cord exit aperture 122. In this embodiment the material is nylon covered, closed cell rubber which generally has exposed rubber material along the edges where it has been die cut. These raw edges can serve to grip the cord 134 in an assembled configuration (not illustrated). The raw edges 143 and 145 of enlarged body portion 191 are illustrated adjacent to the cord entry aperture 120 and function to grip the bundle of cord in a manner similar to the ridge portion 97 described in the cord management organizer 10 embodiment in FIGS. 1-14.

Figure 23:
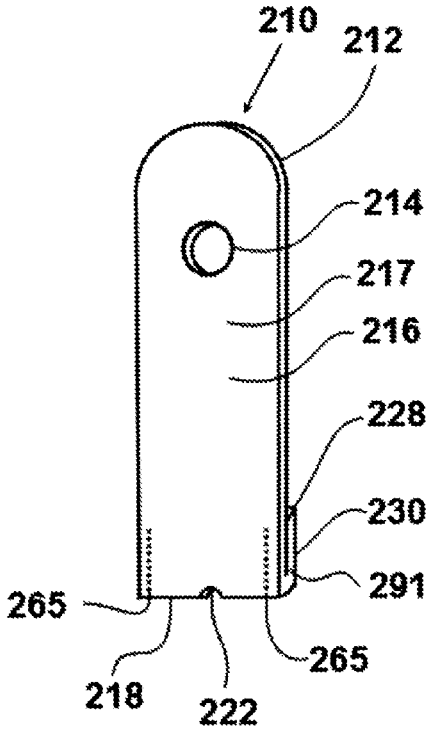
FIG. 23 is a perspective bottom view of a third embodiment of a cord management organizer constructed in accordance with the invention and illustrating another way to create the enlarged body portion.
Figure 24:
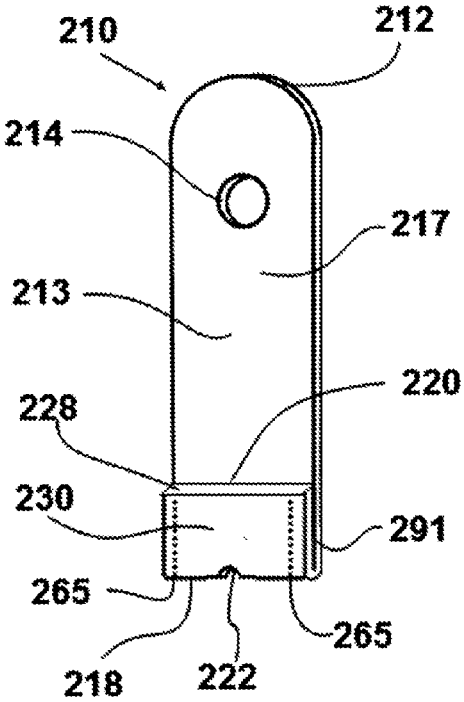
FIG. 24 is a perspective top view of the cord management organizer of FIG. 23.

FIGS. 23-24 illustrate yet a third embodiment and show another way to create the enlarged body portion. 23 is a bottom view and FIG. 24 is a top view. The cord management organizer 210 has a first facing side 213 with an enlarged body portion 291 extending from the plane of the first facing side 216, and a second facing side 213. A plug retention opening 214 is proximate the second end 212. The same closed cell rubber material as described in FIGS. 18-22 is die cut to the appropriate shape including a die cut hole for the plug retention opening and the cord exit aperture. The enlarged body portion 291 is created during manufacture by folding a portion of the elongate body 217 onto itself—at the location of the cord exit aperture such that the fold creates the first end 218. The folded portion 230 of the elongate body 217 that has been folded is affixed along sides as shown by sew lines 265 and 266 creating an enlarged body portion 291. The cord exit aperture 222 combined with the affixed sides effectively create a passageway between the folded material and a cord entry aperture 220 along the raw edge 228 of the folded portion 230. The folded portion 230 serves as an enlarged body portion 291 that functions to grip a portion of the bundle of coils in use in a similar way to the enlarged body portions described in previous embodiments. Additionally, a raw edge of closed cell rubber 228 of the folded portion 230 also serves to grip the bundle of coils (not illustrated) when in use in the assembled configuration. The dimensions for the embodiment in FIG. 9 are substantially the same as for the earlier embodiments with the added dimension for the folded portion 230 being approximately 1.0 cm in length.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A cord management organizer for use with an electrical cord having a plug end and a length of insulated wire, the organizer comprising an elongate body extending from a first end to a second end with an enlarged body portion adjacent the first end, a plug retention opening proximate the second end, and a central region that is located intermediate the plug retention opening and enlarged body portion, the elongate body having an outer, lower surface and an outer, upper surface extending from the second end past the central region to the enlarged body portion, with the elongate body having a thickness between the upper surface and lower surface, the plug retention opening extending through the thickness of the elongate body from the upper surface to the lower surface, the elongate body including a passageway having a central axis that extends through the enlarged body portion in an elongate direction towards the central region of the body;

wherein the enlarged body portion extends upwardly from the upper surface with the passageway extending through only the enlarged body portion from a cord entry opening that is located at least partially above the upper surface and that is located on the central axis in a face of the enlarged body portion that faces toward the central region, to a cord exit opening located on the central axis in a face of the enlarged body portion that faces away from the central region.

2. A cord management organizer as defined in claim 1, the enlarged body portion being configured such that the plug end of the electrical cord is insertable into the passageway along a path of movement starting at the central region with the plug end being inserted into the cord entry opening, through the passageway, and out through the cord exit opening so that at least a portion of the plug end extends out of the passageway past the first end and at least a portion of the cord extends over the upper surface to thereby define an assembled configuration of the organizer and electrical cord.

3. A cord management organizer as defined in claim 2, the body being flexible to permit wrapping of the body about a bundle of the insulated wire, wherein when in the assembled configuration, the first end of the body with the plug end of the cord can be placed at a central portion of the bundle and the body wrapped around the central portion of the bundle with the portion of the plug end being inserted into the plug retention opening to thereby secure the bundle against unbundling.

4. A cord management organizer as defined in claim 1, wherein the body comprises a material that exhibits elasticity.

5. A cord management organizer as defined in claim 4, wherein the material comprises silicone.

6. A cord management organizer as defined in claim 4, wherein the passageway has a diameter when the material is in a relaxed state that is smaller than at least a portion of the plug end, with the elasticity of the material being sufficient to permit expansion of the passageway to a size that allows the plug end to pass through the expanded passageway, whereby the body and electrical cord can be placed into an assembled configuration by inserting the plug end of the electrical cord into the cord entry opening, through the passageway, and out through the cord exit opening such that the plug end extends out of the passageway past the first end of the body and such that a section of the insulated wire that begins at the plug end extends from the passageway along the outer, upper surface of the body towards the central region.

7. A cord management organizer as defined in claim 6, wherein the plug retention opening has a diameter that permits at least a portion of the plug end of the electrical cord to extend through the plug retention opening, whereby when in the assembled configuration, the elongate body may be wrapped around a bundle of the insulated wire and at least the portion of the plug end inserted into the plug retention opening to thereby prevent unbundling of the insulated wire.

8. A cord management organizer as defined in claim 1, wherein the enlarged body portion comprises a pair of ridge portions extending upwardly from the upper surface, the ridge portions being spaced from each other and defining a channel therebetween, wherein the passageway extends through the ridge portions from the cord entry opening located at least partially above the upper surface in a first one of the ridge portions, to the cord exit opening.

9. A cord management organizer as defined in claim 8, wherein the passageway has a cross-sectional shape of a circle with radially-extending slots located at opposite portions of the circle.

* * * * *